US011401756B2

(12) United States Patent
Reddy et al.

(10) Patent No.: US 11,401,756 B2
(45) Date of Patent: Aug. 2, 2022

(54) HIGH-CAPACITY MAST ON A DRILLING RIG

(71) Applicant: Nabors Drilling Technologies USA, Inc., Houston, TX (US)

(72) Inventors: Padira Reddy, Richmond, TX (US); Ashish Gupta, Houston, TX (US)

(73) Assignee: NABORS DRILLING TECHNOLOGIES USA, INC., Houston, TX (US)

( * ) Notice: Subject to any disclaimer, the term of this patent is extended or adjusted under 35 U.S.C. 154(b) by 255 days.

(21) Appl. No.: 16/107,606

(22) Filed: Aug. 21, 2018

(65) Prior Publication Data

US 2019/0063168 A1 Feb. 28, 2019

Related U.S. Application Data

(60) Provisional application No. 62/550,090, filed on Aug. 25, 2017.

(51) Int. Cl.

| | |
|---|---|
| ***E21B 19/15*** | (2006.01) |
| ***E04H 12/34*** | (2006.01) |
| ***E21B 19/16*** | (2006.01) |
| ***E21B 7/02*** | (2006.01) |
| ***E21B 15/00*** | (2006.01) |
| ***E21B 3/04*** | (2006.01) |

(52) U.S. Cl.

CPC ..... *E21B 19/155* (2013.01); *E04H 12/345* (2013.01); *E21B 3/045* (2013.01); *E21B 7/021* (2013.01); *E21B 15/00* (2013.01); *E21B 15/003* (2013.01); *E21B 19/16* (2013.01)

(58) Field of Classification Search

CPC ..... E21B 19/155; E21B 3/045; E04H 12/345
USPC ..... 173/185
See application file for complete search history.

(56) References Cited

U.S. PATENT DOCUMENTS

| | | | | |
|---|---|---|---|---|
| 4,684,306 | A * | 8/1987 | Brewer | E21B 15/00 166/85.5 |
| 6,994,171 | B2 * | 2/2006 | Orr | E21B 15/00 173/24 |
| 7,306,055 | B2 * | 12/2007 | Barnes | E21B 7/02 175/203 |
| 7,308,953 | B2 * | 12/2007 | Barnes | E21B 7/02 175/203 |
| 8,549,815 | B2 * | 10/2013 | Donnally | E21B 7/02 52/745.18 |

(Continued)

*Primary Examiner* — Anna K Kinsaul
*Assistant Examiner* — Himchan Song
(74) *Attorney, Agent, or Firm* — Haynes and Boone, LLP

(57) ABSTRACT

A method of building and operating a land-based drilling rig with a high-capacity mast include providing a platform collapsed on a substructure over a proposed well drilling location and building the high-capacity mast in a horizontal condition by attaching a lower portion of the high-capacity mast to the platform. The high-capacity mast having an opening formed therein sized to accommodate four Range 2 pipes or three Range 3 pipes. The high-capacity mast may be raised from the horizontal condition to a vertical condition by pushing the side of the high-capacity mast to pivot the high-capacity mast about a pivot point on the platform. The platform may be raised from a collapsed condition to a raised condition over the substructure. Some implementations include dual racking boards on the high-capacity mast.

12 Claims, 11 Drawing Sheets

(56) References Cited

U.S. PATENT DOCUMENTS

| | | | | |
|---|---|---|---|---|
| 8,904,716 | B2 * | 12/2014 | Donnally | E21B 7/00 52/114 |
| 8,959,874 | B2 * | 2/2015 | Wasterval | E21B 7/021 52/745.18 |
| 10,648,240 | B2 | 5/2020 | Reddy et al. | |
| 10,704,337 | B2 | 7/2020 | Gupta et al. | |
| 2003/0172599 | A1 * | 9/2003 | Frink | E21B 15/003 52/116 |
| 2013/0340356 | A1 * | 12/2013 | Flusche | E21B 19/086 29/428 |
| 2015/0135607 | A1 * | 5/2015 | Ferrari | E04H 12/345 52/745.18 |
| 2016/0312543 | A1 * | 10/2016 | Cheng | E04H 15/62 |
| 2017/0350153 | A1 * | 12/2017 | Reddy | B66F 7/0633 |
| 2018/0030788 | A1 * | 2/2018 | Reddy | E21B 15/00 |
| 2018/0073306 | A1 * | 3/2018 | Verhoef | E21B 47/12 |
| 2019/0106945 | A1 * | 4/2019 | Basile | E21B 7/02 |

* cited by examiner

HIGH-CAPACITY MAST ON A DRILLING RIG

PRIORITY

This application claims the benefit of the filing date of U.S. Provisional Patent Application 62/550,090, filed Aug. 25, 2017, which is incorporated herein by reference in its entirety.

BACKGROUND OF THE DISCLOSURE

The present disclosure relates in general to drilling rigs, and in particular to drilling rigs having a horizontally-assembled high-capacity mast.

Drilling operations often require intermittent removal of a drill string from a wellbore in a process sometimes referred to as "tripping out". This occurs, for example, when it is desirable to introduce casing into the wellbore. During this time, rotation of the drill string and circulation of drilling fluids are typically suspended. The drill string is then lifted by lifting equipment attached to a mast located above the wellbore and broken down into stands of pipe. As the stands of pipe are removed from the drill string, each is accommodated within a racking board that is attached to the mast. Generally, a derrick man located on the racking board guides each stand of pipe into a storage position on the racking board. "Tripping in" is the process of reassembling the drill string after the drill bit is replaced and is very similar to tripping out, except that the steps are reversed. The suspension of drilling operations and accompanying mud circulation while tripping in or tripping out can damage the condition of the wellbore. Additionally, any delay to the drilling operations delays the progress of the well.

Conventional masts on a land-based drilling rig have a height enabling them to accommodate stands of pipe up to about 100 feet long. The stands may be made up of 3 tubulars, each having a length in a range of 30 to 33 feet. Accordingly, when tripping out or tripping in, a connection or disconnection from the drill string occurs about every 100 feet. Any reduction of time required for tripping in and tripping out could increase the drilling efficiency of the well, resulting in lower costs and higher returns.

The present disclosure is directed to a cantilevered drilling rig and methods that overcome one or more of the shortcomings in the prior art.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
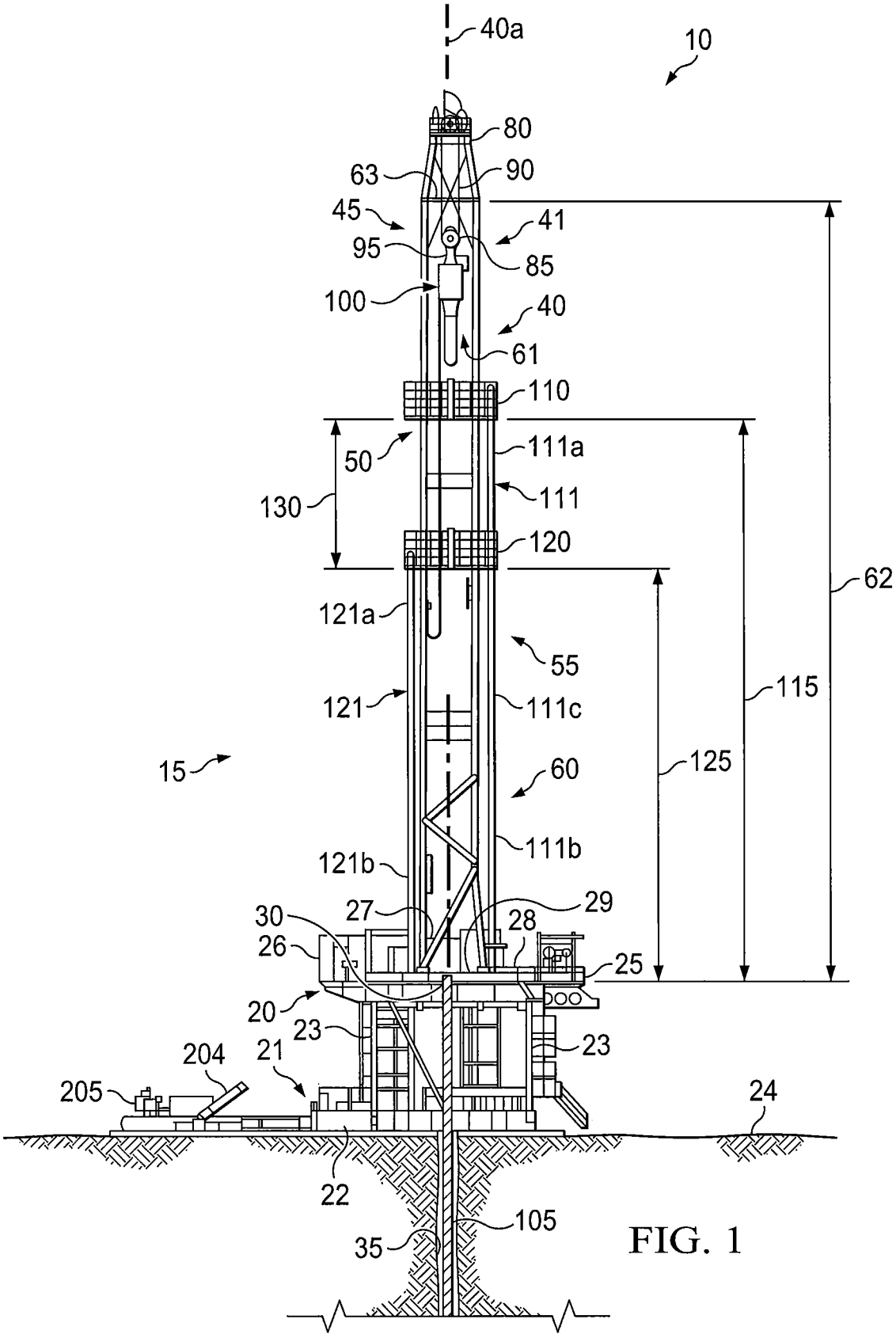
FIG. 1 is side view of an apparatus shown as a drilling rig according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

This disclosure is directed to an apparatus that may form all or a part of a land-based drilling rig with a cantilever mast capable of performing drilling operations in an efficient manner. The example drilling rig includes a vertically extending high-capacity mast that is arranged and configured to accommodate pipe stands made of either four API Range 2 drill pipes or three API Range 3 drill pipes. A single Range 2 drill pipe is typically 27 to 31 feet in length. A single Range 3 drill pipe is typically 42 to 46 feet in length. Accordingly, the highly efficient drilling rig described herein may accommodate drill string stands of four Range 2 pipes having a combined length in a range of 108 to 124 feet, or drill string stands of three Range 3 pipes having a combined length in a range of 126 to 138 feet. To do this, the high-capacity mast includes a front opening sized to receive the extra long drill string stands. Because the drilling rig is capable of using drill pipe stands of either four Range 2 drill pipes or three Range 3 drill pipes, the efficiency of operation may be increased over conventional systems that may be arranged to accommodate stands of only three Range 2 drill pipes or two Range 3 drill pipes.

The use of the pipe stands having a total length about 108 to 138 feet requires fewer connections (performed in an in-line position) between stands than tubular stands having shorter lengths, while still achieving the same total drill string length. Accordingly, make-up and break-down of the drill string while drilling, tripping in, or tripping out is more efficient, saving time and reducing drilling costs.

In some implementations, the high-capacity mast includes a drill string racking board that is sized and configured to rack stands having a total length of about 108 feet to about 138 feet or even longer, and a casing string racking board that is sized and configured to rack stands of casing. The stands of casing may be formed of casing stands having a total length of about 80 to 100 feet, and more regularly 85 to 90 feet, and may be formed of two or three pipes of casing. Because the drill string stands—having a total length of about 108 feet to about 138 feet—are capable of being racked in the drill string racking board, the area footprint on the rig floor associated with the racked drill string stands is reduced while the setback capacity remains the same (or is increased). Due to the reduced area footprint on the drill floor associated with the racked drill string stands, there may be additional room on the rig floor to rack casing stands vertically in the casing string racking board. The ability to rack the casing string stands decreases the time required to position a next section of casing to an in-line position over the wellbore. This use of the casing string stands having a length of about 85 feet to 95 feet requires fewer connections in the in-line position than the use of a single casing string section having a length of about 45 feet, while still achieving the same total casing string length.

In addition, the drilling rig with the high-capacity mast may be set up in an efficient and effective manner, while still providing the desired capability of accommodating drill string stands of either four Range 2 drill pipes or three Range 3 drill pipes. In some implementations, the high-capacity drilling mast is assembled in a relatively horizontal condition, extending from a collapsed drill floor a distance greater than the height of either four Range 2 drill pipes or three Range 3 drill pipes. In some implementations, the high-capacity drilling mast pivoted from a substantially horizontal condition to a substantially vertical condition. The drill floor may then be raised from its collapsed condition to a vertical condition in a manner that allows the high-capacity drilling mast to perform drilling operations.

FIG. 1 illustrates an elevation view of apparatus 10. The apparatus 10 may form a part of or may be an entire land-based, drilling rig 15. In some implementations, the drilling rig may be rig having a cantilever mast and, in some implementations a collapsible platform. In one embodiment, the drilling rig 15 includes a platform 20 and a substructure 21. The substructure 21 comprises a ground engaging foundation 22 and a plurality of struts or columns 23 pivotably extending between the foundation 22 and the platform 20. The substructure 21 is positioned above and in contact with a pad or directly on a ground 24. In an assembled condition as is shown in FIG. 1, the platform 20 and the substructure 21 are positioned above a wellbore 35, which can be an existing wellbore or a planned wellbore.

The platform 20 includes a platform floor or a drill floor 25 disposed above the substructure 21. The drill floor 25 is arranged and configured to support drilling equipment and additional rig structures. For example, it may support or include a driller's cabin 26, an iron roughneck 27, a drawworks 28, a rotary table 29, a well center 30, a mousehole, motors, winches, a deadline anchor and other components. Portions of these additional structures will be identified herein in the discussion relating to FIG. 4.

The apparatus 10 also includes a high-capacity mast 40 supporting lifting equipment 41 above the drill floor 25. The mast 40 includes a top section 45, an upper intermediate section 50, a lower intermediate section 55, and a bottom section 60. In an exemplary embodiment, the lower intermediate section 55 and the bottom section 60 are each about forty to fifty-five feet in length. The upper intermediate section 50 is about twenty-five feet to forty feet in length. The mast top section 45 is also about forty to fifty-five feet in length, and in some implementations, is about forty to fifty feet in length. In an exemplary embodiment, the upper intermediate section 50 has a top portion that is configured to be coupled to a bottom portion of the top section 45, the lower intermediate section 55 has a top portion that is configured to be coupled to a bottom portion of the upper intermediate section 50, and the top portion that is configured to be coupled to a bottom portion of the lower intermediate section 55, and the bottom section 60 has a top portion that is configured to be coupled to a bottom portion of the lower intermediate section 55.

The lifting equipment 41 includes a crown block 80 and a traveling block 85. The crown block 80 is coupled to the top section 45 of the mast 40, and the traveling block 85 hangs from the crown block 80 by a drilling line 90. It should be understood that other conventional techniques for arranging a rig do not require a drilling line, and these are included in the scope of this disclosure. A hook 95 is attached to the bottom of the traveling block 85. A top drive 100 is suspended from the hook 95. Alternatively or in addition, hydraulic elevators (not shown) are attached to the traveling block 85 using bails (not shown) that may be used to raise and lower a drill string 105.

A drill string racking board 110 or a monkey board is attached to the upper intermediate section 50. However, the drill string racking board 110 may be attached to any of the sections of the high-capacity mast 40 at a location adjacent the high-capacity mast 40 such that the drill string rack board 110 is spaced by a distance 115 above the drill floor 25. In some embodiments, the distance 115 is greater than 110 feet and less than 125 feet. However, the distance 115 can be any distance within the range of 100 feet to 200 feet. For example, the drill string racking board 110 may be located in a range of about 115 to 120 feet above the drill floor 25. Additional distances, both larger and smaller are also contemplated.

A casing string racking board 120, or monkey board, is attached to the lower intermediate section 55. However, the casing string racking board 120 may be attached to any of the sections of the mast 40 at a location adjacent the mast 40 such that the casing string rack board 120 is spaced by a distance 125 above the drill floor 25. In some embodiments, the distance 125 is greater than 70 ft. and less than 100 ft. However, the casing string racking board 120 can be at any height within the range of 60 feet above the drill floor 25 to 150 feet above the drill floor 25. In some examples, the casing string racking board 120 may be located about 75 to 90 feet above the drill floor 25, and in some examples, about 82 to 87 feet above the drill floor 25. Additional heights, both larger and smaller are also contemplated. In an exemplary embodiment, the drill string racking board 110 and the casing string racking board 120 are vertically spaced along a longitudinal axis 40*a* of the mast 40 by a distance 130. In some embodiments, the distance 130 is about 28 to 34 feet, but can be as large as 60 ft. and as small as 15 ft. In some embodiments, the distance 130 is about 22 to 36 feet. Additional vertically spaced distances are also contemplated. While vertically spaced along the axis 40*a*, the racking boards 110 and 120 extend from the same side of the mast 40 in the same direction such that the boards 110 and 120 are stacked vertically. That is, the casing string racking board 120 is aligned with the drill string racking board 110 in two dimensions, such as the y and z directions, but vertically spaced from each other in the x direction.

In an exemplary embodiment, the drill string racking board 110 accommodates drill string sections, or drill string stands 111 having a total length in the range of about 100 ft. to 121 ft. In FIG. 1, only a single drill string stand 111 is shown, however as will be apparent from the discussion herein, the drilling rig 15 and the drill string racking board 110 accommodates many drill string stands 111. In some embodiments, the drill string stand 111 comprises four (4) sections of pipe, such as Range 2 pipes, with each section or individual pipe having a length of about 27 ft. to 31 ft. for a total length of about 108 feet to 124 feet. In other embodiments, the drill string stand 111 comprises three (3) sections of pipe such as three Range 3 pipes, with each section of pipe having a length of about 42 ft. to 46 ft. for a total length of about 126 feet to 138 feet, although in some instances, range 3 pipes may have smaller lengths for a minimum length of 114 feet.

Generally, each drill string stand 111 has a first end portion 111*a* forming an upper end when the drill string stand is in a vertical orientation; an opposing second end portion 111*b* that forms a lower end and that rests on the drill floor 25; and a middle portion 111*c* extending between the first and second end portions. When racked, the first end portion 111*a* is coupled to the drill string racking board 110, the middle portion 111*c* is accommodated within the casing string racking board 120, and the second end portion 111*b* rests on the drill floor 25. The drill string stand 111 has an inner diameter and an outer diameter. In some embodiments, the outer diameter is approximately (within 10%) 4 inches, 4.5 inches, 5 inches, 5.5 inches, or 6.0 inches. However, the outer diameter may be less than 4 inches and greater than 6 inches. In an exemplary embodiment, the drill string 105 includes multiple drill string stands 111 coupled together.

In an exemplary embodiment, the casing string racking board 120 accommodates casing or liners sections, or casing stands 121 having a total length in a range of 80 ft. to 100 ft. In FIG. 1, only a single casing stand 121 is shown, however as will be apparent from the discussion herein, the drilling rig 15 and the casing string racking board 120 accommodates many casing stands 121. In some embodiments, the casing stands 121 comprise two sections of casing, with each section of casing having a length of about 40 ft. to 50 ft., for a total length of about 80 to 100 feet. In other embodiments, the casing stands 121 have a total length of approximately 85 to 90 ft. Generally, each casing stand 121 has a first end portion 121*a* forming an upper end when the casing stand is arranged in a vertical orientation and an opposing second end portion 121*b* that forms a lower end and that rests on the drill floor 25. When racked, the first end portion 121*a* is coupled to the casing string racking board 120 and the second end portion 121*b* rests on the drill floor 25. The casing stand 121 has an inner diameter, which is larger than the outer diameter of the drill string stand 111. Generally, the inner diameter of the casing stand 121 is greater than the outer diameter of the drill string stand 111 such that the drill string stand 111 can extend within a passageway that defines the inner diameter of the casing stand 121. In some embodiments, the casing stand 121 has an inner diameter that is greater than 4.5 inches, greater than 5 inches, greater than 5.5 inches, or greater than 6.0 inches. However, the inner diameter of the casing stand 121 may be less than 4.5 inches. In some embodiments, the inner diameter of the casing stand 121 may be any dimension that is greater than 4.5 inches and less than 22 inches. In some embodiments, the casing stand 121 may be any one of a conductor casing, a surface casing, an intermediate casing, a production casing, and a production liner.

The high-capacity mast 40 includes an opening 61 extending from the drill floor 25 to the mast top section 45. The opening 61 is sized to receive pipe stands of four Range 2 pipes and pipe stands of three Range 3 pipes. Since in some embodiments, these pipe stands may range in size from 108 to 138 feet in length, the opening 61 may have an opening height 62 extending at least 145 feet above the drill floor 25, and in some implementations, at least 180 feet. Accordingly, in some implementations, the opening 61 may be sized in a range of about 145 to 165 feet. In other implementations, the opening 61 may be sized in a range of about 155 to 220 feet. Other sizes, including sizes up to 250 feet are also contemplated.

Since the opening 61 extends from the drill floor to a height accommodating drill string stands, it should be apparent that each of the mast top section 45, mast upper intermediate section 50, mast lower intermediate section 55, and the mast bottom section 60 all are arranged to form a part of the opening. To do this, these sections of the high-capacity mast 40 may have a C-shaped in cross-section with one open side forming a portion of the opening 61. Accordingly, in some implementation of the high-capacity mast 40, the opening 61 is formed only on a single side of the mast. In such implementations, the three remaining sides of the mast may be at least partially closed by structural supports. The opening 61 may face the drill string racking board 110 and the casing string racking board 120, and may provide access to an inside region of the mast 40 above well center 30. Accordingly, a racker device or pipe handler on the drilling rig 40 may access and physically displace drill string stands or casing string stands from well center within the mast to the racking boards, and vice versa.

In the implementation shown, the opening 61 extends from a cross support 63 providing structural stability to the mast top section 45 to the drill floor 25. As can be seen in FIG. 1, the opening 61 is tall enough to accommodate not only the drill string stand 111, but in this example, also exposes at least a part of the lifting equipment 41 and top drive 100, even while they are raised adjacent to a top of the high-capacity mast 40. In other implementations, the opening 61 is sized closer to the actual size of the drill string stand 111.

Figure 2:
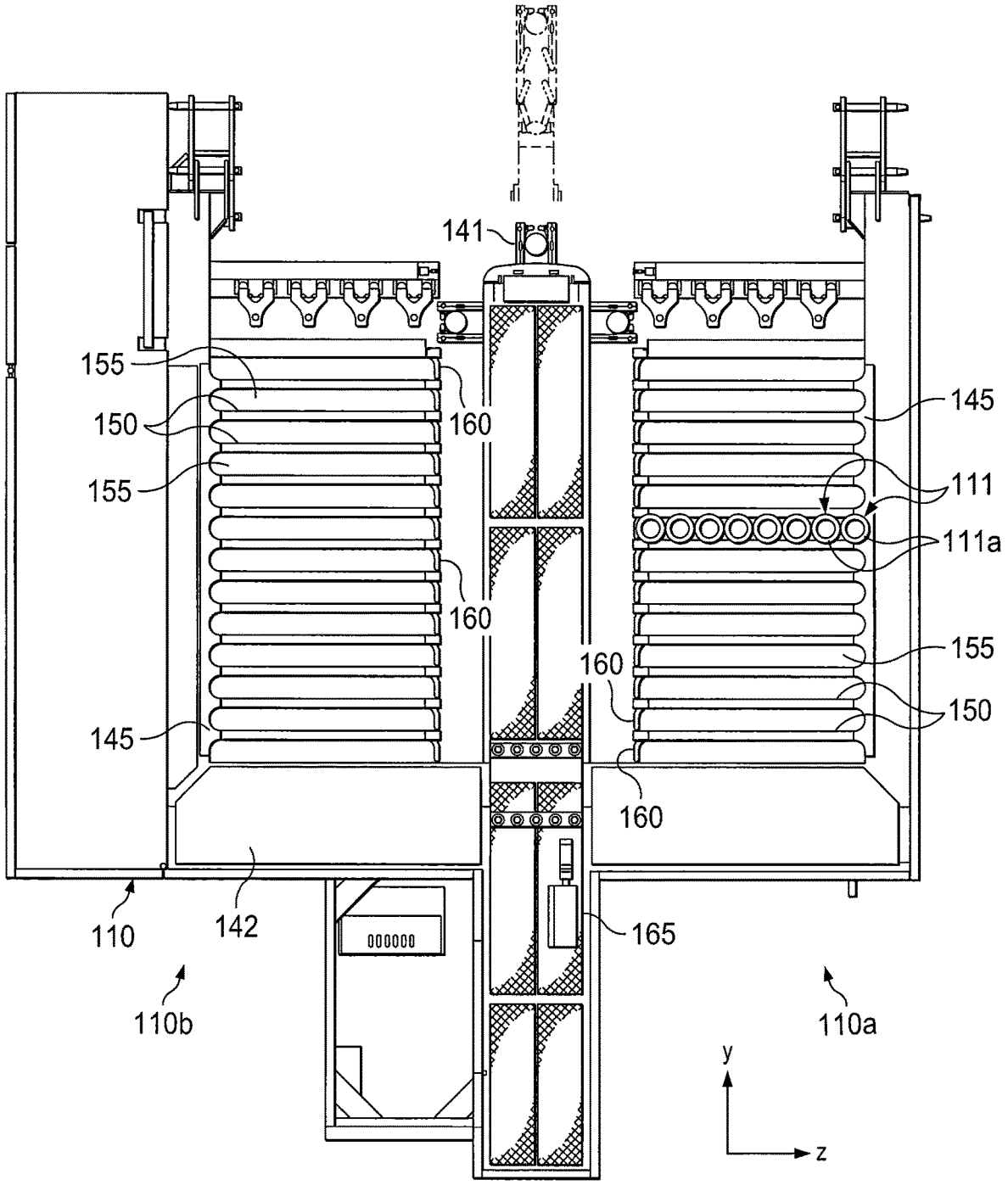
FIG. 2 is a plan view of a racking board forming a part of the apparatus of FIG. 1 according to one or more aspects of the present disclosure.

FIG. 2 shows the drill string racking board 110 in greater detail. In an exemplary embodiment and as illustrated in FIG. 2, the racking board 110 includes a floor 142 and cantilever beams 145 extending perpendicular to the mast 40 (shown in FIG. 1). Fingers 150 extend from each of the cantilever beams 145 to form channels 155 that accommodate the drill string stands 111. This example shows a row of drill string stands 111 in the drill string racking board 110. The drill string stands 111 enter and exit each of the channels 155 via channel openings 160. In this example, the drill string racking board 110 includes an automatic stand transfer vehicle 141 with a track 165 that is adjacent the channel openings 160 and extends parallel to the cantilever beams 145. In some embodiments, a first set of fingers 150 extends in a first direction and a second set of fingers 150 extends in a second direction that is opposite the first direction. The first set of fingers 150 form a first portion 110*a* of the drill string racking board 110 and the second set of fingers 150 form a second portion 110*a* of the drill string racking board 110. Generally, the drill string stands 111 having an overall length within the ranges described above (such as having a length made of four Range 2 pipes or three Range 3 pipes) are accommodated within one of the portions 110*a* and 110*b* with the other of the portions 110*a* and 110*b* remaining empty of the drill string stands 111. For example, the drill string stands 111 are accommodated within the first portion 110*a* of the drill string racking board 110.

Figure 3:
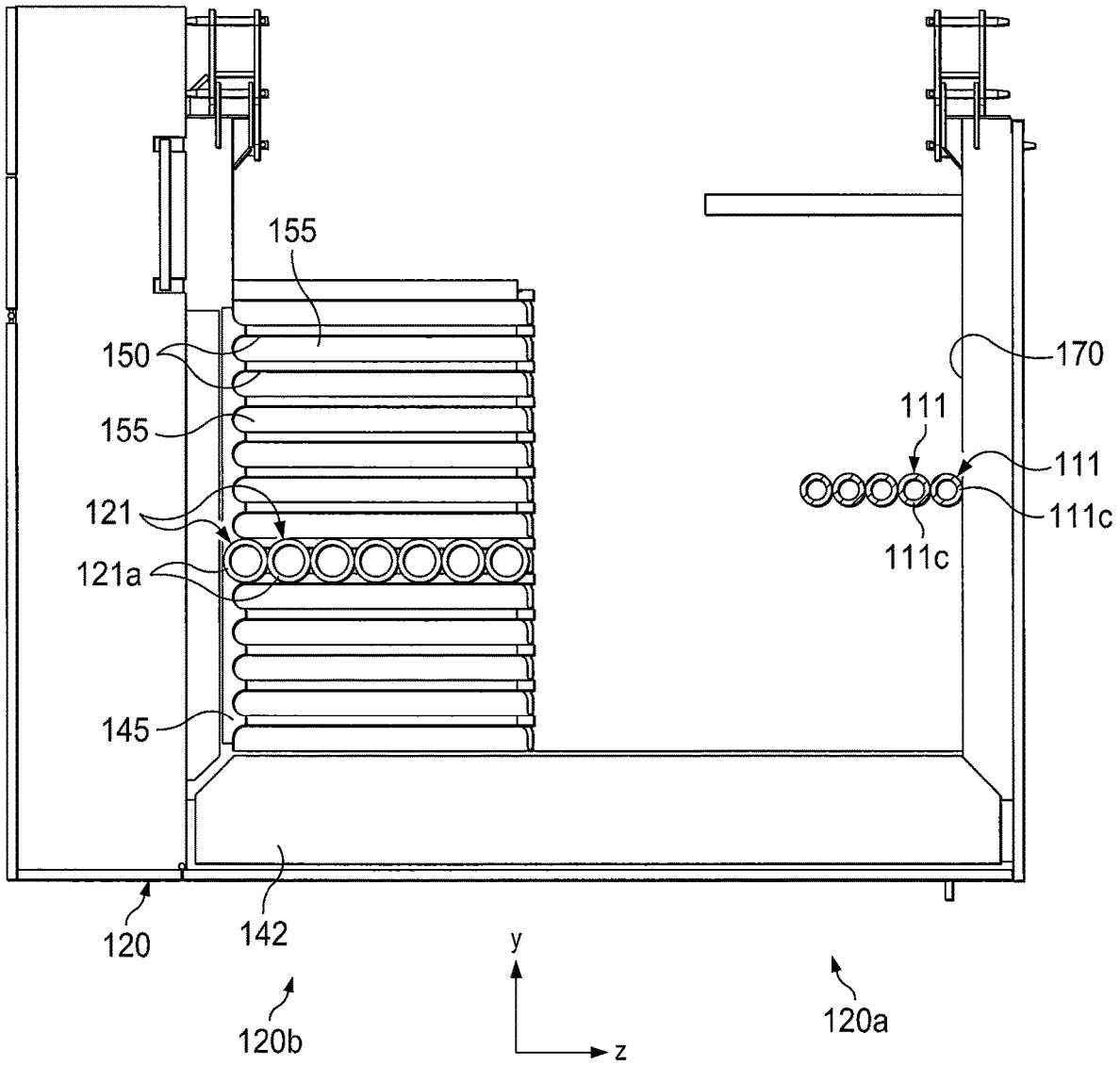
FIG. 3 is a plan view of another racking board forming a part of the apparatus of FIG. 1 according to one or more aspects of the present disclosure.

FIG. 3 shows the casing string racking board 120 in greater detail. In an exemplary embodiment, the casing string racking board 120 is similar to the drill string casing board 110, with the elements common between the casing string racking board 120 and the drill string racking board 110 being identified with the numerals associated with the elements from the drill string racking board 110. That is, the casing string racking board 120 also includes fingers 150 that form channels 155. In some embodiments, the casing string racking board 120 is similar to the drill string casing board 110 except that the casing string racking board 120 is sized and configured to accommodate drill string stands 111 in a first portion 120*a* of the casing string racking board 120 and is sized and configured to rack casing stands 121 in a second portion 120*b* of the casing racking board 120. Generally, the channels 155 in the second portion 120*b* receive and accommodate the first end portions 121*a* of the casing stands 121. In some embodiments and as shown, fingers are omitted from the second portion 120*b* and the drill string stands 111 are accommodated within a vertically extending opening 170 formed in the casing string racking board 120. Generally, the middle portion 111*c* of the drill string stands 111 are accommodated within the opening 170. In some embodiments, the fingers 150 are not omitted from the portion 120*a* of the casing string racking board 120 and instead, the channels 160 formed by the fingers 150 in the portion 120*a* are sized to accommodate the drill string stands 111.

Figure 4:
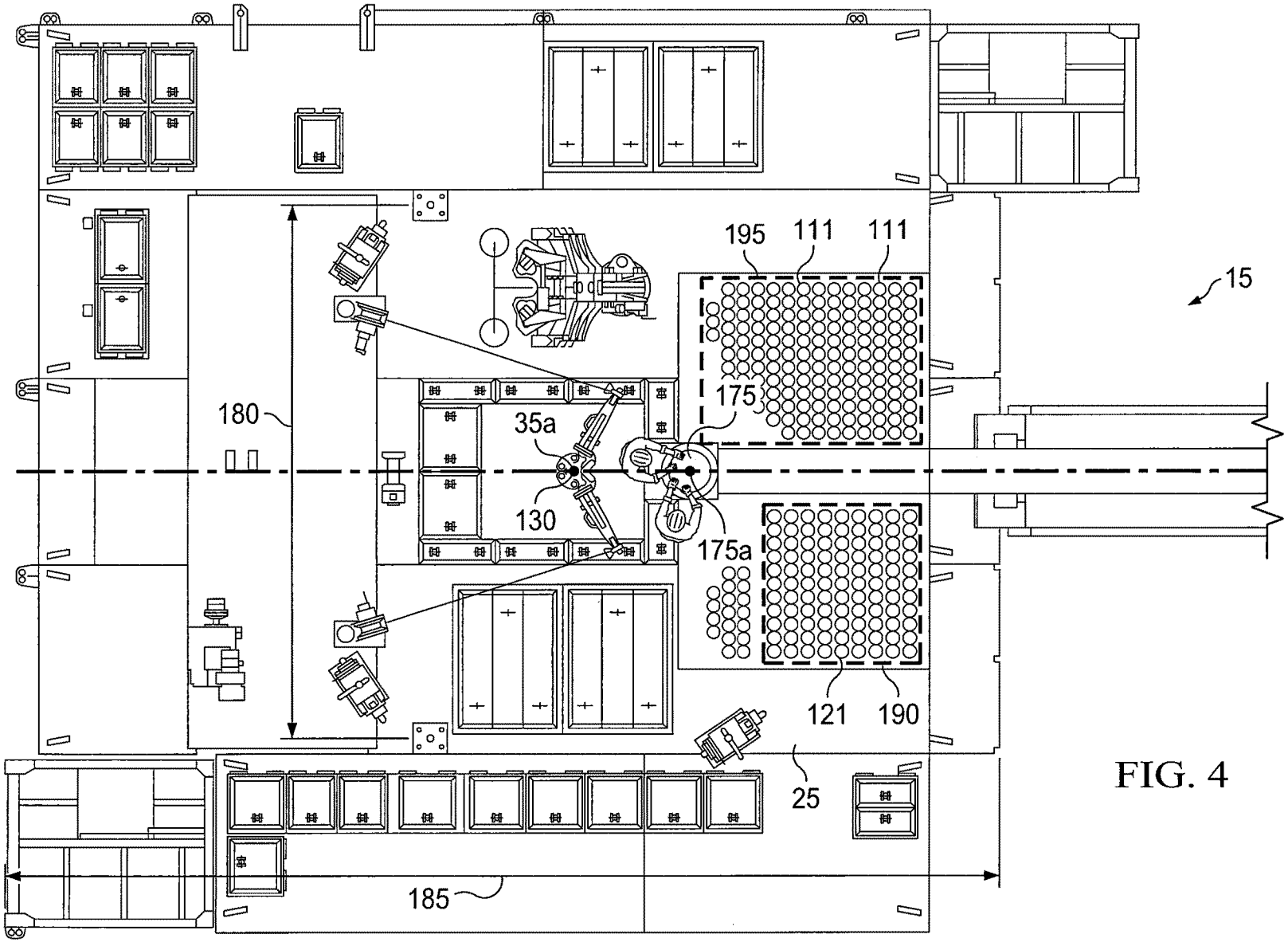
FIG. 4 is a plan view of a drill floor forming a part of the apparatus of FIG. 1 according to one or more aspects of the present disclosure.

FIG. 4 illustrates a plan view of the drill floor 25. As shown, a mouse hole 175, having a center line 175*a*, is laterally offset from a centerline 35*a* of the wellbore 35, with the centerline 35*a* being collinear with the well center 30. Thus, stand building of the drill string stands 111 and/or the casing string stands 121 may occur off-well center utilizing the mouse hole 175 that is disposed in a position that allows stand building free from interference with the drilling equipment at well center, such as the top drive 100 for example. As used herein, the term "off-well center" is meant to include a position that does not interfere with drilling equipment at well center. This may encompass at least a portion of the offline position and at least a portion of the online position. In some embodiments, the drill floor 25 has a first dimension 180 about 20 ft. to about 40 ft. and a second dimension 185 about 40 ft. to about 60 ft. such that the area of the drill floor surface is about 800 sq. ft. to about 2,400 sq. ft. In some embodiments, the area of the drill floor surface is about 1,055 sq. ft. Larger and smaller drill floor areas are also contemplated. As shown, the casing racking board 120 stores or racks the casing string stands 121 within a square footage, or an area footprint 190 on the drill floor 25 and the drill string racking board 110 stores or racks the drill string stands 111 within a square footage, or a second area footprint 195 on the drill floor 25. In an exemplary embodiment, the area footprint 190 is approximately 43 sq. ft., but can be any square footage of about 35 sq. ft. to 55 sq. ft. Additional sizes, both larger and smaller are also contemplated. In an exemplary embodiment, the area footprint 195 is approximately 65 sq. ft., but can be any square footage between 55 sq. ft. and 75 sq. ft. Additional sizes, both larger and smaller are also contemplated. In an exemplary embodiment, the ratio of the square footage of the area footprint 190 to the square footage of the area footprint 195 is between about 1 to 2.

Figure 5A:
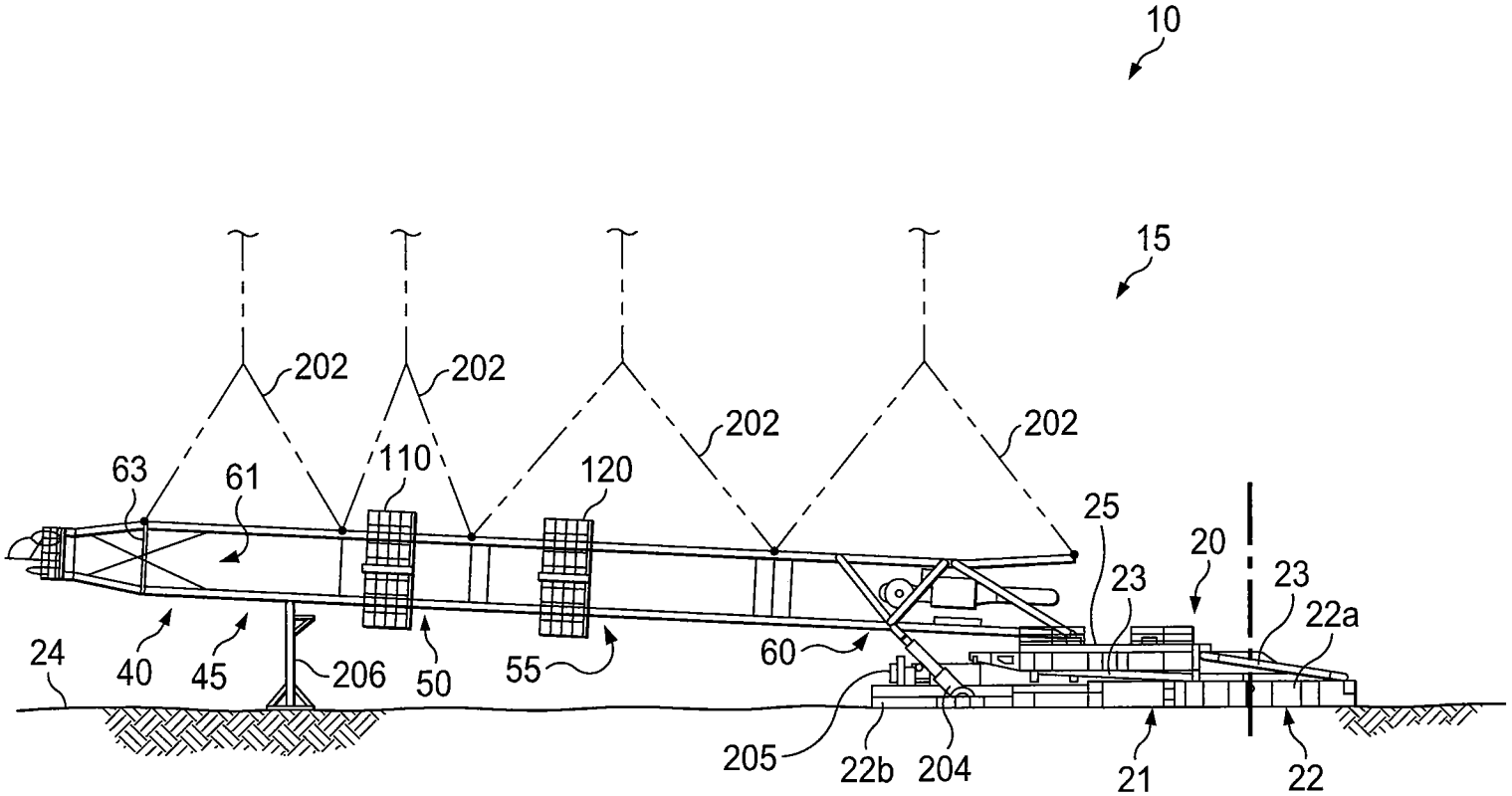
FIG. 5A is a side view the apparatus of FIG. 1 according to one or more aspects of the present disclosure.

FIGS. 5A-5D are a series of drawings illustrating a method of assembling and erecting the drilling rig 15 including the high-capacity mast 40. FIG. 5A illustrates the platform 20, the substructure 21, and the high-capacity mast 40. In this position, the substructure 21 is disposed with the foundation 22 in contact with and resting on the ground 24, which may represent a well pad. The foundation 22 includes a main foundation 22*a* and a hydraulic sled portion 22*b* connected with and disposed to the side of the main foundation 22*a*. The main foundation 22*a* may be in multiple parts, and may be arranged to support the weight of the platform 20, the high-capacity mast 40, as well as the weight of the drill string stands 111 and casing string stands 121. The main foundation 22*a* is disposed over a well to be drilled.

Here, the platform 20 is shown in a collapsed condition on the substructure 21. The struts or columns 23 of the substructure 21 extend from a pivotable joint on the main foundation 22*a* to a pivotable joint on the platform 20. As such, while the main foundation 22*a* is disposed over a well to be drilled, the platform 20 is laterally offset from the well to be drilled when in the collapsed condition.

With the platform 20 and substructure 21 in the collapsed condition, the high-capacity mast 40 may be assembled into a horizontal condition by connecting the mast bottom section 60, by itself and independent of the top section 45, the upper intermediate section 50, and the lower intermediate section 55, to the drill floor 25 on the platform 20. The mast bottom section 60 may be attached to the drill floor 25 at a pivotable joint. In the example shown, a sling 202 may be connected with the mast bottom section 60 and a crane (not shown) may be connected to the sling 202 in order to manipulate the mast bottom section 60 and hold it in place until it can be secured to the pivotable joint on the drill floor 25 of the platform 20.

A hydraulic cylinder 204 carried by the hydraulic sled portion 22*b* and supported by a hydraulic pump 205 may be arranged to support a portion of the weight of mast bottom section 60. Accordingly, with the bottom section 60 in place, the hydraulic cylinder 204 may be extended and connected to a side of the bottom section 60. As will be described herein, the hydraulic cylinder 204 may be used to support the mast 40 during assembly and when in the horizontal position, and also to raise the mast from a horizontal condition to a vertical condition.

With the mast bottom section 60 secured at a bottom end to the pivotable joint, the sling 202 may be removed from the mast bottom section 60 and connected to the lower intermediate section 55. The lower intermediate section 55 may then be lifted by the crane and positioned adjacent the mast bottom section 60. The lower intermediate section 55 may then be connected to the mast bottom section 60 using a fastener or other connection in a manner known in the art. In some implementations, the casing string racking board 120 may have been pre-attached to the mast lower intermediate section 55. In other implementations, the lower intermediate section 55 is first connected to the mast bottom section 60 before attaching the casing string racking board 120. The sling 202 may then be removed from the lower intermediate section 55 for use with the remaining structures of the high-capacity mast 40.

The sling 202 may then be placed on the mast upper intermediate section 50, and a crane may lift and position the mast upper intermediate section 50 in a position where it may be connected to the lower intermediate section 55. Similar to the mast lower intermediate section 55, the upper intermediate section 50 may include or may not include the drill string racking board 110 when it is attached to the lower intermediate section 55. Finally, the mast top section 45 is lifted by the sling 202 and connected to the mast upper intermediate section 50. In some implementations, the mast top section 45 is supported by a support stand 206 while being connected to the upper intermediate section 50. In other implementations, the mast top section 45 is first attached to the mast upper intermediate section 50, which is supported by the hydraulic cylinder 204. Then with the mast top section 45 in place, the complete high-capacity mast 40 may be lowered by adjusting the hydraulic cylinder 204 to be supported by the hydraulic cylinder, the platform 20, and the support stand 206. As would be understood of ordinary skill, the building of the high-capacity also includes aligning the openings in each mast section to form the opening 61. With the sections of the high-capacity mast 40 in an assembled configuration, the drill string racking board 110 and the casing string racking board 120 may be respectively connected to the upper and lower intermediate sections 50 and 55, if not connected previously.

Figure 5B:
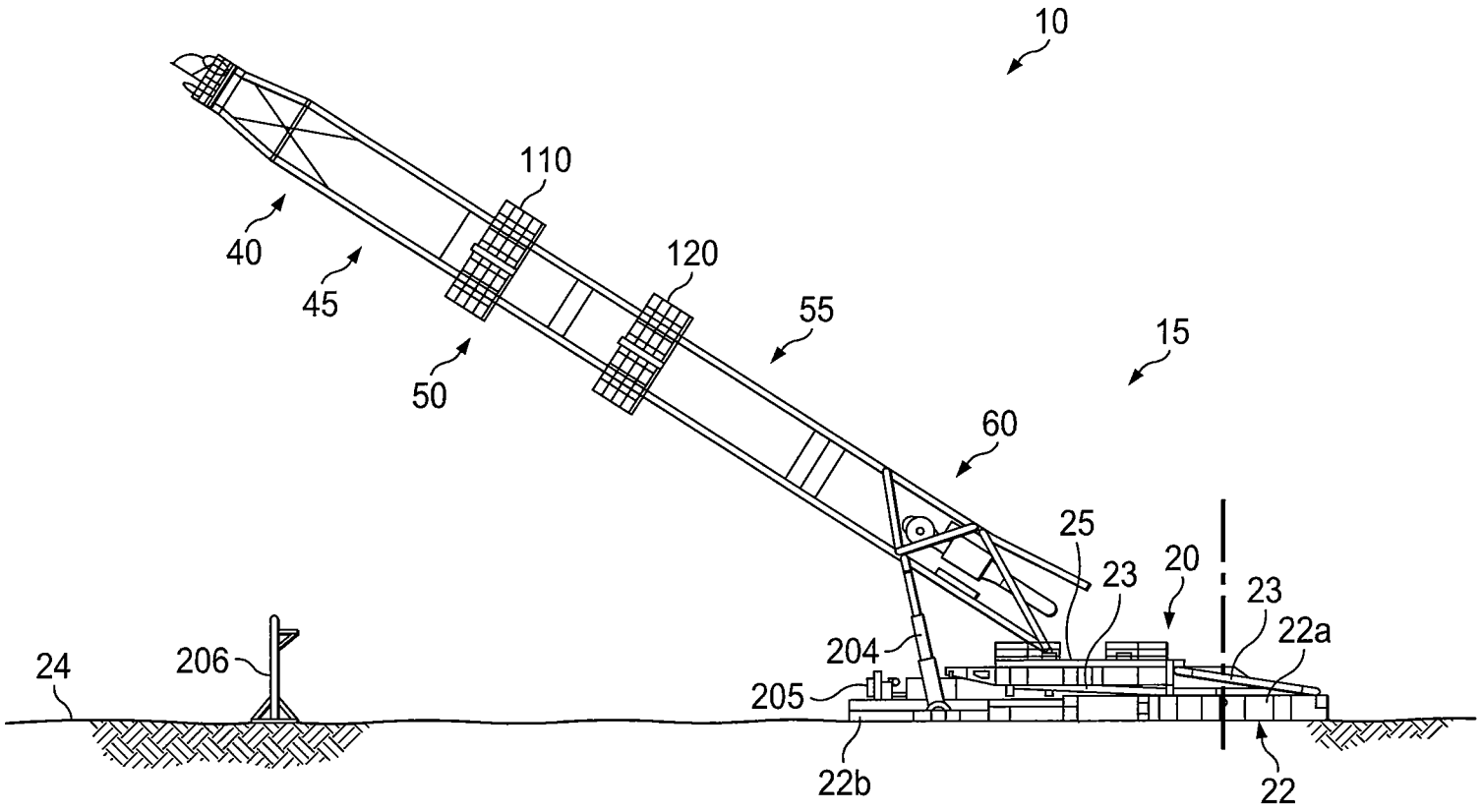
FIG. 5B is a side view the apparatus of FIG. 1 according to one or more aspects of the present disclosure.
Figure 5C:
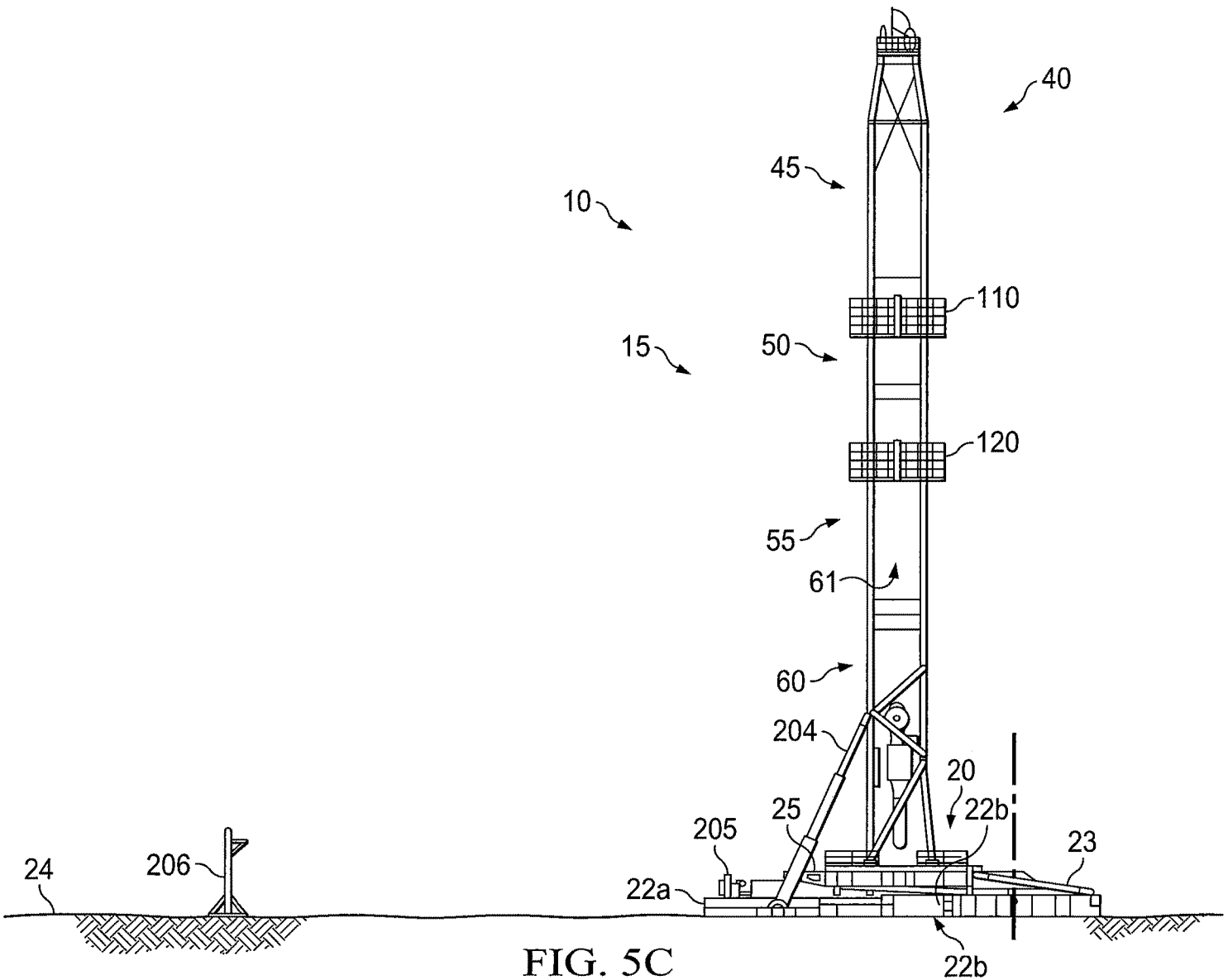
FIG. 5C is a side view the apparatus of FIG. 1 according to one or more aspects of the present disclosure.
Figure 5D:
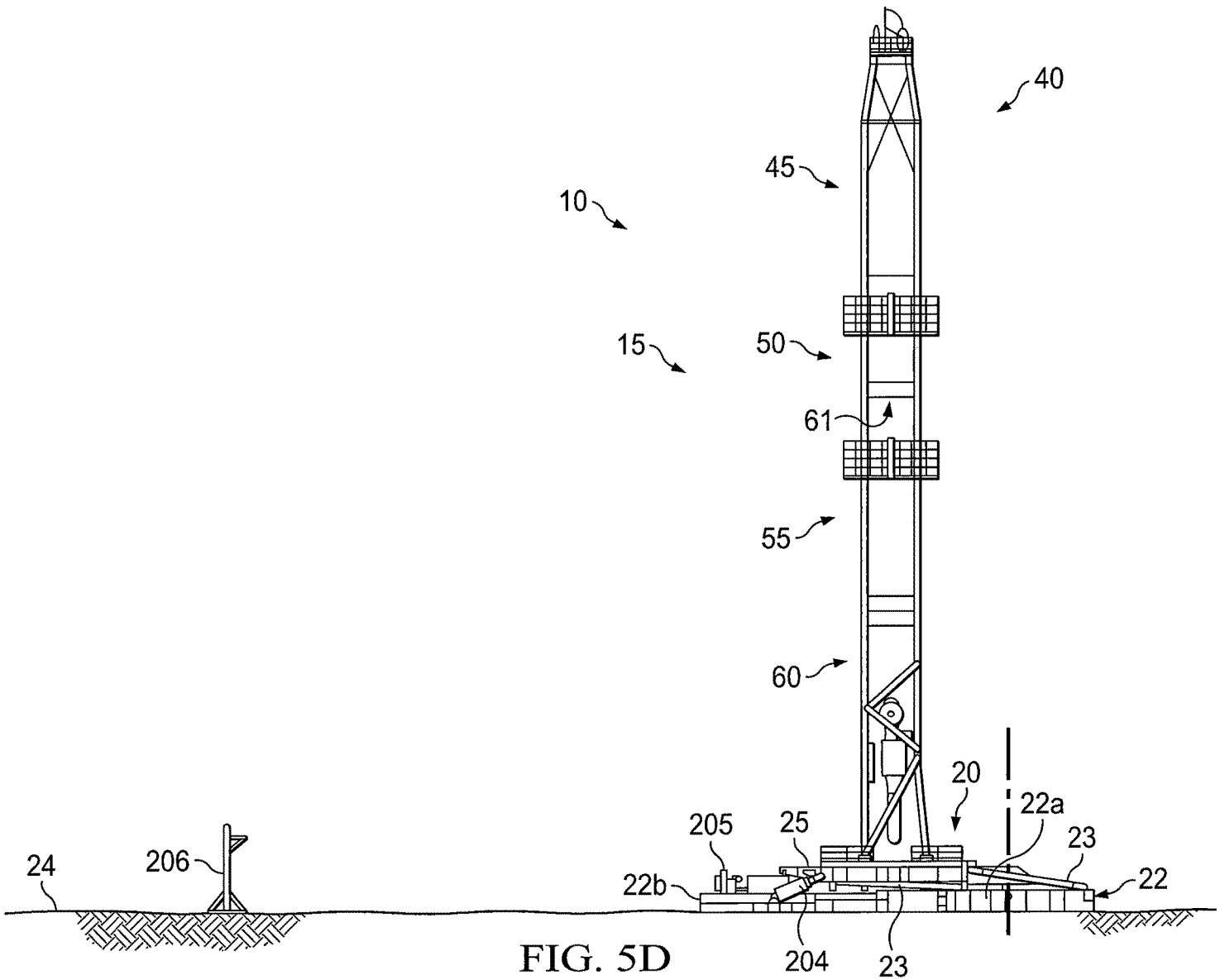
FIG. 5D is a side view the apparatus of FIG. 1 according to one or more aspects of the present disclosure.

FIG. 5B shows the high-capacity mast 40 in a partially raised state. Here, the hydraulic cylinder 204 is extended to pivot the high-capacity mast 40 about the pivot joint on the drill floor 25. FIG. 5C shows the high-capacity mast 40 in a substantially vertical condition on the collapsed platform 20. With the high-capacity mast 40 in this condition, the mast bottom section 60 may be fixed to the drill floor 25 in a manner preventing the mast from toppling back toward the horizontal position. Accordingly, the racking boards 110, 120 and the opening 160 to the high-capacity mast 40 through which pipe and casing stands may be introduced are at a desired elevation relative to the drill floor. FIG. 5D shows the high-capacity mast 40 in a vertical condition on the collapsed platform 20. The hydraulic cylinder 204 has been disconnected from the mast 40, rotated, and connected to the collapsed platform 20.

With the high-capacity mast 40 and a vertical orientation, additional equipment may be introduced and secured on the drill floor 25. For example, the driller's cabin 26, the iron roughneck 27, the drawworks 28, and other equipment may be introduced and secured in place on the drill floor 25.

As shown in FIG. 5D, the hydraulic cylinder 204 may be then connected to the collapsed platform 20, and may be extended to pivot the platform 20 about the struts or columns 23 to raise the platform to the assembled condition shown in FIG. 1. The hydraulic cylinder 204 may then be disconnected from the platform and the high-capacity mast 40 may be ready for use. In some implementations, rather than using the hydraulic cylinder 204 to raise the mast, a crane may be used to pivot the mast from its horizontal assembly condition to the vertical operational position.

Figure 6:
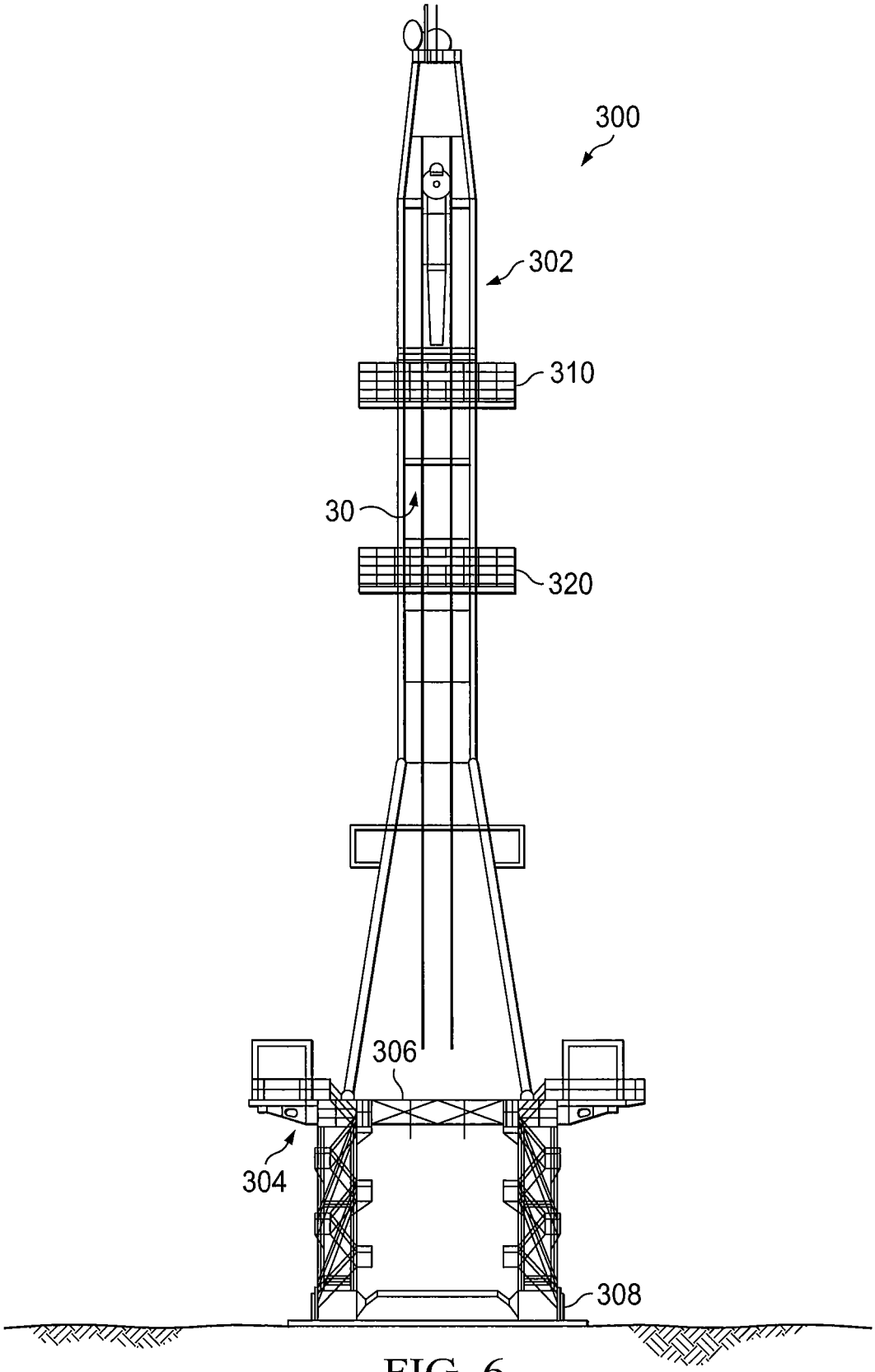
FIG. 6 is a side view of another apparatus shown as a drilling rig according to one or more aspects of the present disclosure.
Figure 7:
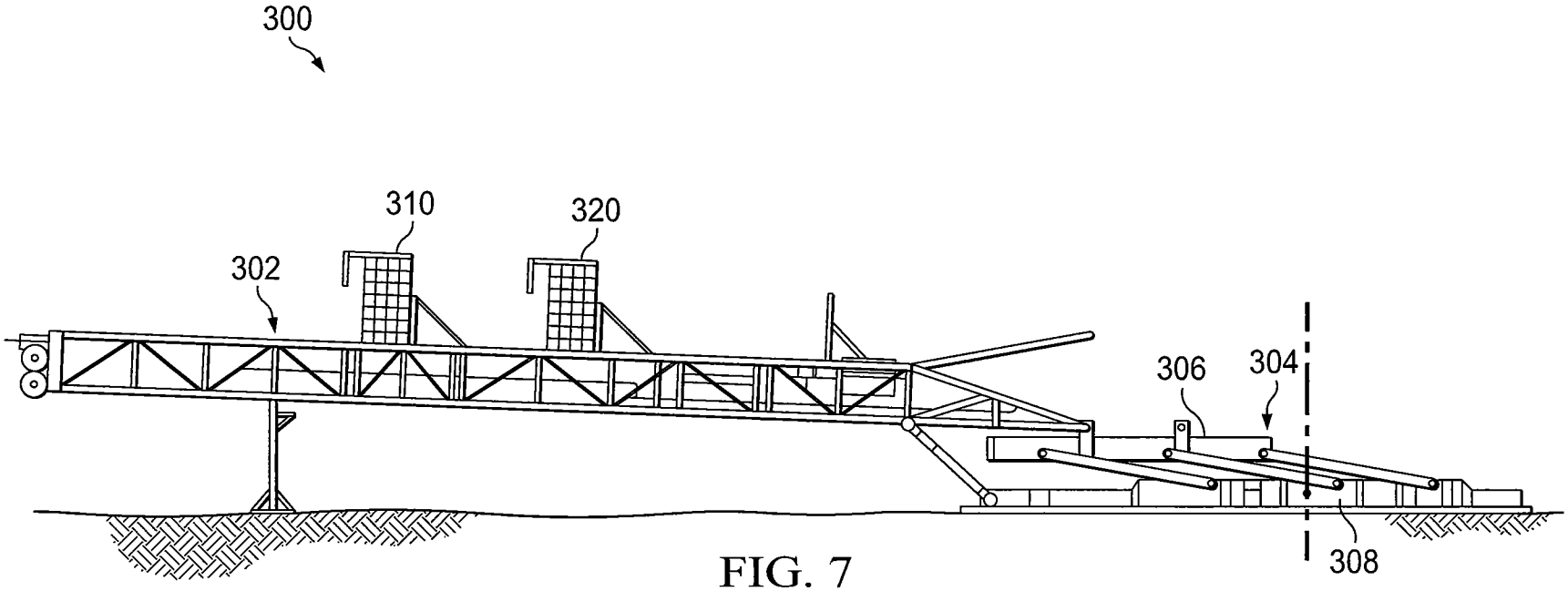
FIG. 7 is a side view of another apparatus shown as a drilling rig according to one or more aspects of the present disclosure.

FIGS. 6 and 7 show another implementation of an apparatus 300 that may be a drilling rig with a high-capacity mast 302 including a drill string racking board 310 and a casing string racking board 320. The high-capacity mast 302 extends from a platform 304 having a drill floor 306 and a substructure 308. The high-capacity mast 302 in this implementation also includes four main sections, with the drill string racking board 310 supported by the mast upper intermediate section and the casing string racking board 320 supported by the lower intermediate section. This implementation is similar to the implementation described with reference to FIGS. 1-4 and 5A-5B, and therefore will not be re-described in great detail. However, it is worth noting that in this implementation, the drill string racking board 110 and the casing string racking board 120 are disposed at the upper side of the high-capacity mast 302 when the high-capacity mast 302 is in a horizontal position. Accordingly, in this implementation, the opening 309 into the high-capacity mast 302 through which stands of four range 2 pipes and stands of three range 3 pipes is also disposed on the upper facing side of the high-capacity mast 302 when the high-capacity mast 302 is in a horizontal position.

Figure 8:
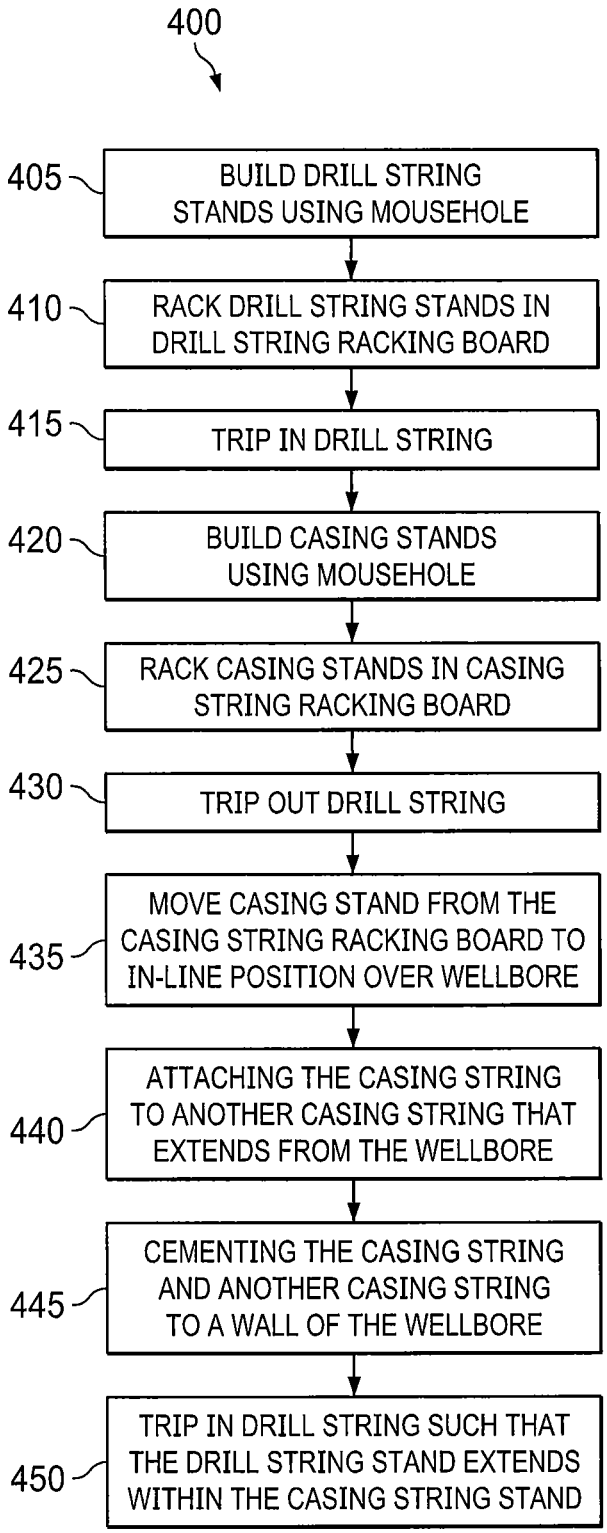
FIG. 8 is a flow chart diagram of at least a portion of a method according to one or more aspects of the present disclosure.

FIG. 8 sets forth an example method of using the sling-shot style rig with the high-capacity mast having two fingerboards. It is described with reference to FIGS. 1-4, 5A-5D, although the method will also be applicable to the apparatus 300 described with reference to FIGS. 6 and 7. The method of operating the apparatus 10 is generally referred to by the reference numeral 400. The method may include operation of the apparatus 10 after it is set up according to the method described with reference to FIGS. 5A-5D.

At 405, the method may include building the drill string stand 111 using the mouse hole 175. This may include building a drill string stand having a length in the range of 108 to 138 feet. This may include building a drill string stand having four Range 2 pipes or having three Range 3 pipes. In some implementations, this may include building a drill string stand in the range of 108 to 138 feet. In other implementations, this may include building a drill string stand having a length about 108 to 200 feet.

At 410, one of the drill string stands 111 is racked in the drill string racking board 110. In some implementations, the first end portion 111*a* is secured to the drill string racking board 110 while the middle portion 111*c* extends through the opening 170 of the casing string racking board 120 or is accommodated with the casing string racking board 120. In some embodiments, the second end portion 111*b* rests within the area 195 of the drill floor 25.

At 415, the method includes performing a drilling operation such as drilling a wellbore or "tripping in" using one or more of the drill string stands 111. This step includes moving one of the drill string stands 111 from the drill string racking board 110 and to an in-line position over the wellbore 35. This may include introducing the drill string stand through the opening into the central region of the mast. The drill string stand may be disposed over well center during makeup or connection to the drill string. The top drive may then be used to advance the drill string into the well bore.

At 420, a casing string stand 121 may be built using the mouse hole 175. In an exemplary embodiment, a casing section is transferred from its horizontal position at its location remote from the drill floor 25 and presented by a catwalk or other conveyance to a vertical position. The casing section is then transferred into the mouse hole 175 for the building of the casing stand 121. The casing stands 121 and/or the drill string stands 111 may be built and racked simultaneous to drilling operations at well center in some embodiments. In some implementations, the casing string stand 121 may have a length in a range of about 80 to 100 feet long. In other implementations, the casing string stand 121 may have even greater lengths such as up to about 150 feet. Accordingly, the casing string stand may have a length that is shorter than the distance from the drill floor to the drill string racking board 110.

At 425, the casing string stand 121 is racked in the casing string racking board 120. In some embodiments, the first end portion 121*a* of the casing string stand 121 is racked within the channels 160 of the casing string racking board 120 while the second opposing end portion 121*b* rests within the area 190 of the drill floor 25.

At 430, operators may decide to perform another drilling operation such as tripping out the drill string 105. This may be done for maintenance purposes, completion of a drilling run, or for other purposes.

At 435, the casing stand 121 is moved from the casing string racking board 120 and to an in-line position over the wellbore 35. This may include introducing the casing stand 121 through the opening in the high-capacity mast over the wellbore.

At 440, the casing stand 121 is attached to another casing stand 121 that extends from the wellbore.

At 445, the casing stand 121 and the another casing stand 121 are cemented to a wall of the wellbore 35. Thus, the casing stand 121 is configured to be cemented to the wall of the wellbore 35. In some embodiments, the casing stand 121 is cemented to the wall of the wellbore 35 to prevent contamination of fresh water well zones, prevent unstable upper formations from caving and sticking to the drill string 105 or forming large caverns, isolate different zones, seal off high pressure zones from the surface, prevent fluid loss into or contamination of production zones, and/or provide a smooth internal bore for installing production equipment.

At 450, the drill string 105 is tripped in such that one of the drill string stands 111 extends within the casing string stand 121. In some embodiments, the drill string 105 is tripped in after the casing string stands 121 are cemented to the wall of the wellbore.

In an exemplary embodiment, the method 400 may be used make-up or break-down the drill string 105 using drill string stands 111. Due to the total length of the drill string stands 111 being greater than conventional drill string stands, the area 195 required of the drill floor 25 to accommodate a set back of 21,000 ft. of drill pipe is less than the area required to accommodate a similar set back when using drill string stands with shorter lengths. For example, a setback of 21,000 ft. of drill pipe may be stored within the area 195 when the area 195 is approximately 65 sq. ft. Due to the reduced area of the drill floor 25 used to provide a setback of 21,000 ft., the casing string stands 121 are capable of being racked (in vertical arrangement) on the drill floor 25 using the casing racking board 120. Accordingly, casing can be installed quicker than when individual sections of casing are oriented into a vertical orientation one-by-one. Moreover, with fewer connections required (due to two casing sections forming a casing stand 121), the speed at which casing can be installed increases. In an exemplary embodiment, the method 400 may increase efficiency during casing operations (i.e., placing casing into the wellbore). In an exemplary embodiment, the method 400 may result in an increased day rate.

Generally, each of the racking boards 110 and 120 store the stands 111 and 121 in a vertical position or generally vertical (within 10 degrees) position. A pipe stand may be either a casing stand 121 or a drill string stand 111. As the rig 15 includes the drill string racking board 110 and the casing string racking board 120, the rig 15 is a dual racking board rig.

In view of all of the above and the figures, one of ordinary skill in the art will readily recognize that the present disclosure introduces a drilling apparatus and methods.

The present disclosure is directed to methods of building a land-based drilling rig, that includes providing a platform collapsed on a substructure over a proposed well drilling location; building a high-capacity mast in a horizontal condition by attaching a lower portion of the high-capacity mast to the platform, the high-capacity mast having an opening formed therein sized to accommodate four Range 2 pipes or three Range 3 pipes; raising the high-capacity mast from the horizontal condition to a vertical condition by pushing the side of the high-capacity mast to pivot the high-capacity mast about a pivot point on the platform; and raising the platform from a collapsed condition to a raised condition over the substructure and securing the platform in the raised condition.

In some aspects, building the high-capacity mast in the horizontal condition comprises: attaching a mast bottom section to the platform at a pivot joint; attaching a mast lower intermediate section to the mast bottom section; attaching a mast upper intermediate section to the mast lower intermediate section; attaching a mast top section to the mast upper intermediate section; attaching a first racking board to the upper intermediate section; and attaching a second racking board to the lower intermediate section. The method may include attaching a first racking board to the high-capacity mast and attaching a second racking board to the high-capacity mast at a position displaced along the mast from the first racking board. The method may include comprising introducing a pipe stand of four Range 2 pipes into the opening in the high-capacity mast to perform a drilling operation. The method may include removing a pipe stand of four Range 2 pipes from the opening in the high-capacity mast while performing a drilling operation. In some aspects the opening in the high-capacity mast has a height from a drill floor of the platform in a range of 145 to 250 feet. In some aspects the pipe stand of four Range 2 pipes has an overall length about 108 to 124 feet. In some aspects the first racking board is spaced from the second racking board along the high-capacity mast by a distance of about 15 to 40 feet. In some aspects the opening in the high-capacity mast faces upwardly when the mast is in the horizontal condition. In some aspects the opening in the high-capacity mast faces toward a lateral side when the mast is in the horizontal condition. The method may include introducing a plurality of pipe stands to the drilling rig for vertical storage in a racking board, each of the plurality of pipe stands having a length about 108 to 138 feet. The method may include introducing a plurality of casing stands to the drilling rig for vertical storage in a racking board at the same time that the plurality of pipe stands are stored, each of the plurality of casing stands having a length about 80 to 100 feet.

In some exemplary aspects, the present disclosure is directed to methods of building and using a land-based drilling rig, comprising: placing a platform collapsed over a substructure over a proposed well drilling location, the platform having a rig floor; building a high-capacity mast by attaching a mast bottom section to the platform at a pivot joint, attaching a mast lower intermediate section to the mast bottom section, attaching a mast upper intermediate section to the mast lower intermediate section, attaching a mast top section to the mast upper intermediate section, and attaching a first racking board to the upper intermediate section, the racking board being disposed about 100 to 200 feet from a bottom of the mast bottom section, and wherein the mast bottom section, lower intermediate section, upper intermediate section, and top section each have an opening in a side thereof sized in a range of 145 to 250 feet; raising the high-capacity mast from the horizontal condition to a vertical condition by pivoting the high-capacity mast about a pivot point on the platform; and raising the platform from a collapsed condition to a raised condition over the substructure and securing the platform in the raised condition.

The method may include attaching a second racking board to the lower intermediate section, the second racking board being disposed at a height about 60 to 150 feet above the rig floor. In some aspects the first and second racking board each have fingers forming channels, the fingers of each of the first and second racking being spaced differently to form differently sized channels. In some aspects the first and second racking boards are disposed between 15 and 40 feet apart along the length of the racking board. In some aspects the platform supporting the high-capacity mast is sized less than 2400 feet. In some aspects introducing pipe stands having a length about 108 to 138 feet into the opening to perform a drilling operation.

In some exemplary aspects the present disclosure is directed to drilling rig apparatus comprising: a platform collapsible on a substructure over a proposed well drilling location, the platform comprising a limited sized drill floor less than 2400 square feet; a high-capacity mast pivotable about joint connecting a lower portion of the high-capacity mast to the platform between a horizontal condition and a vertical condition, the high-capacity mast having an opening formed therein sized to accommodate stands four Range 2 pipes or three Range 3 pipes; an actuating mechanism configured to pivot the high-capacity mast from the horizontal condition to the vertical condition and to pivot the platform to a raised position over the substructure; and a fingerboard attached to the high-capacity mast at a location along the mast about 100 to 200 feet from the bottom of the mast.

In some aspects the high-capacity mast comprises four sections attached in series to form the opening.

In several exemplary embodiments, the elements and teachings of the various illustrative exemplary embodiments may be combined in whole or in part in some or all of the illustrative exemplary embodiments. In addition, one or more of the elements and teachings of the various illustrative exemplary embodiments may be omitted, at least in part, and/or combined, at least in part, with one or more of the other elements and teachings of the various illustrative embodiments.

Any spatial references such as, for example, "upper," "lower," "above," "below," "between," "bottom," "vertical," "horizontal," "angular," "upwards," "downwards," "side-to-side," "left-to-right," "right-to-left," "top-to-bottom," "bottom-to-top," "top," "bottom," "bottom-up," "top-down," etc., are for the purpose of illustration only and do not limit the specific orientation or location of the structure described above.

In several exemplary embodiments, while different steps, processes, and procedures are described as appearing as distinct acts, one or more of the steps, one or more of the processes, and/or one or more of the procedures may also be performed in different orders, simultaneously and/or sequentially. In several exemplary embodiments, the steps, processes and/or procedures may be merged into one or more steps, processes and/or procedures.

In several exemplary embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations.

Although several exemplary embodiments have been described in detail above, the embodiments described are exemplary only and are not limiting, and those skilled in the art will readily appreciate that many other modifications, changes and/or substitutions are possible in the exemplary embodiments without materially departing from the novel teachings and advantages of the present disclosure. Accordingly, all such modifications, changes and/or substitutions are intended to be included within the scope of this disclosure as defined in the following claims. In the claims, any means-plus-function clauses are intended to cover the structures described herein as performing the recited function and not only structural equivalents, but also equivalent structures.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. § 1.72(b) to allow the reader to quickly ascertain the nature of the technical disclosure. It is submitted with the understanding that it will not be used to interpret or limit the scope or meaning of the claims.

Moreover, it is the express intention of the applicant not to invoke 35 U.S.C. § 112, paragraph 6 for any limitations of any of the claims herein, except for those in which the claim expressly uses the word "means" together with an associated function.

What is claimed is:

1. A method of building a slingshot style land-based drilling rig, comprising:

providing a platform collapsed on a substructure over a proposed well drilling location;

assembling a high-capacity mast with a first racking board and a second racking board in a horizontal condition by:

attaching a mast bottom section of the high-capacity mast to the platform;

while suspending a mast lower intermediate section of the high-capacity mast horizontally with a sling, attaching the mast lower intermediate section of the high-capacity mast to the mast bottom section of the high-capacity mast;

attaching the second racking board to the lower intermediate section;

after attaching the second racking board to the lower intermediate section, attaching a mast upper intermediate section to the mast lower intermediate section;

attaching the first racking board to the mast upper intermediate section;

attaching a mast top section to the mast upper intermediate section; the assembled high-capacity mast in the horizontal condition having an opening formed therein sized to accommodate four Range 2 pipes or three Range 3 pipes connected together, the first racking board sized to accommodate four Range 2 pipes or three Range 3 pipes connected together, and the second racking board sized to accommodate stands of casing;

raising the high-capacity mast from the horizontal condition to a vertical condition by pushing a side of the high-capacity mast to pivot the high-capacity mast about a pivot point on the platform such that the second racking board is disposed between the first racking board and the platform; and raising the platform from a collapsed condition to a raised condition over the substructure and securing the platform in the raised condition.

2. The method of claim 1, wherein assembling the high-capacity mast in the horizontal condition comprises:

attaching the mast bottom section of the high-capacity mast to the platform at a pivot joint.

3. The method of claim 2, wherein the first racking board is disposed 15 to 40 feet from the second racking board along the high-capacity mast.

4. The method of claim 1, further comprising attaching the first racking board to the high-capacity mast and attaching the second racking board to the high-capacity mast at a position displaced along the mast from the first racking board.

5. The method of claim 1, comprising introducing a pipe stand of four Range 2 pipes into the opening in the high-capacity mast to perform a drilling operation.

6. The method of claim 1, comprising removing a pipe stand of four Range 2 pipes from the opening in the high-capacity mast while performing a drilling operation.

7. The method of claim 1, wherein the opening in the high-capacity mast has a height from a drill floor of the platform in a range of 145 to 250 feet.

8. The method of claim 7, wherein the four Range 2 pipes has an overall length of 108 to 124 feet.

9. The method of claim 1, wherein the first racking board extends upwardly away from the platform when the mast is in the horizontal condition.

10. The method of claim 1, wherein the opening in the high-capacity mast faces toward a lateral side when the mast is in the horizontal condition.

11. The method of claim 1, comprising introducing a plurality of pipe stands to the drilling rig for vertical storage in the first racking board, each of the plurality of pipe stands having a length of 108 to 138 feet.

12. The method of claim 11, comprising introducing a plurality of casing stands to the drilling rig for vertical storage in the second racking board at the same time that the plurality of pipe stands are stored, each of the plurality of casing stands having a length of 80 to 100 feet.

* * * * *